United States Patent [19]

Parker

[11] Patent Number: 4,463,848

[45] Date of Patent: Aug. 7, 1984

[54] COUPON SECRETARY

[76] Inventor: Elizabeth Parker, 281 Canada St., Lake George, N.Y. 12845

[21] Appl. No.: 49,901

[22] Filed: Jun. 19, 1979

[51] Int. Cl.[3] ..... A45C 11/34

[52] U.S. Cl. ..... 206/214; 383/38; 206/425; 206/371

[58] Field of Search ..... 206/214, 371, 439.7, 206/425; 150/38, 39, 14, 2.5; 190/52

[56] References Cited

U.S. PATENT DOCUMENTS

| | | | |
|---|---|---|---|
| 193,340 | 7/1877 | Lothrop | 206/214 X |
| D. 238,010 | 12/1975 | Canton | 190/52 |
| 250,234 | 11/1881 | Grumel | 206/214 X |
| 348,124 | 8/1886 | Hood | 206/214 X |
| 1,560,442 | 11/1925 | Trowbridge | 150/38 |
| 1,753,663 | 4/1930 | Miller | 206/425 |
| 1,832,900 | 11/1931 | Godfrey | 150/38 |
| 2,105,163 | 1/1938 | Scandore | 206/214 X |
| 3,164,430 | 1/1965 | Been et al. | 206/214 X |

FOREIGN PATENT DOCUMENTS

| | | | |
|---|---|---|---|
| 75557 | 1/1918 | Switzerland | 206/425 |

*Primary Examiner*—Joseph Man-Fu Moy

*Attorney, Agent, or Firm*—Cushman, Darby & Cushman

[57] ABSTRACT

A convenient collecting, carrying and organizing case for discount coupons, box tops, premium coupons and other grocery shopping items that can be used at home and carried to the store to maximize the availability and effectiveness of such coupons.

6 Claims, 3 Drawing Figures

36
34
30
32
48
46
44
FORGET ME NOT
42
10
26
28
20
18
DEC
NOV
OCT
SEPT
AUG
JULY
JUNE
MAY
APR
MAR
FEB
1980 JAN
DEC
NOV
OCT
SEPT
AUG
JULY
JUNE
MAY
APR.
MAR
FEB
1979 JAN.
68
66
24
80
78
76
16
72
74
50
52
70
54
56
12
40
38
60
SHOPPING MEMO
58
·BREAD
·EGGS
·MILK
·POLISH
·TEA
·VEGETABLES
·SUGAR
·BUTTER
·COOKIES
·MEAT
·FISH
·FRUIT
·CLEANSER
·BLEACH
·DETERGENT
·SOAP

COUPON SECRETARY

BACKGROUND OF THE PRESENT INVENTION

For many years manufacturers of a wide variety of grocery store products including cereals, puddings, coffee and bathroom supplies to name just a few have regularly and systematically offered discount coupons to purchasers of such products in an effort to encourage further purchases of those goods at discounted prices. Additionally, product manufacturers of various types of packaged products sometimes have special purchase offerings if a number of package ends, special labels or proof of purchase seals are collected and sent in with the purchase price of the offered item.

Traditionally, these discount or premium coupons, labels or other like items are packaged within or form part of the packaging for the purchased goods. Thus, they are not available for immediate use. Accordingly, it is necessary for shoppers to collect and save discount coupons, proof of purchase seals, labels, ends or portions of boxes or other like items so that they may be used subsequently. The problem that often occurs is that after having collected coupons, and for that matter even after particular coupons have been selected for use during the next shopping trip, the coupons are left at home. At other times, the shopping list is enlarged while at the store and there is no way to check the supply of coupons at home to determine whether there are any that could be used with the added items.

Many types of portable and compartmented handbags exist for allowing women to carry a variety of personal items and included among such examples are those shown in the following U.S. Pat. Nos. 2,650,630; 2,937,680; 3,335,775; 3,874,435 and 4,098,312. The concepts in these patents have ranged from a quick change handbag insert, as shown in U.S. Pat. No. 2,650,630, to a purse which includes a plurality of drawers as in U.S. Pat. No. 4,098,312. Most have a number of compartments for holding bills, checkbooks, vanity cases, lipsticks, combs, cigarettes, keys and change purses as well as make-up items including tissues and face creams. Some, as in U.S. Pat. No. 2,937,680, include fold out tray portions which are lighted so that lipsticks, keys or wallets held therein can be easily found in the dark while others include fold out flaps in which open pockets are mounted as in U.S. Pat. No. 3,335,775. Each of these examples, however, discloses only the concept of storing and holding personal items, from cosmetics to checkbooks, and makes their use and the finding of them an easier process. This is accomplished by having delegated particular sections or compartments within these handbags for holding particular types of items.

A second class of compartmented cases include those which attempt to provide a transportable desk or office and examples include U.S. Pat. Nos. 3,232,397; 3,408,126 and 3,904,003. In U.S. Pat. No. 3,232,397 a case for carrying meter reader cards is disclosed which provides internal spaces for holding cards and writing instruments. U.S. Pat. No. 3,408,126 discloses a box-like case adapted to be used as a portable office and it, too, includes a plurality of compartments which can store various office supplies such as papers, staplers, paperclips, envelopes, pencil sharpeners, stamps and file holders. In U.S. Pat. No. 3,904,033 another type of traveling desk is disclosed which also includes spaces for books, large files and pockets or drawers for paperclips, rubberbands, notes, pens or other smaller items.

SUMMARY OF PRESENT INVENTION

The disclosed exemplary and preferred embodiment of the present invention as set forth herein relates to a portable coupon collecting and carrying case or coupon secretary. It can be constructed from a wide variety of materials and includes particular standard elements so as to provide a specially constructed device which can be used to conveniently store and arrange grocery store coupons and other like articles. The device is sized so that it can be conveniently carried to the grocery store and inserted in that portion of most conventional grocery carts provided to hold children. Accordingly, this makes shopping lists, which are included in the device, conveniently available as well as providing the immediate availability of coupons that are to be used during that shopping trip as well as the other collected coupons in case the shopping list is expanded.

The device is comprised primarily of a main case or housing having front, rear, side and bottom walls, together with an attached openable top. An additional front wall can be provided that serves together with a flap on the top wall to comprise the closure means for the case. The interior of the main case is divided at least into two sections by means of an internal wall and provides room for two sets of monthly dividers to allow the current and the following year to be separated into monthly periods. This allows coupons which have been collected to be organized and filed on a month by month basis, according to their expiration date, so that throughout the year it is quickly evident which coupons can still be used. Since coupons are usually issued with expiration dates varying from several months to a year or more, two years worth of filing space is usually sufficient, however, more could be added.

A plurality of pockets are provided on the inside of the top wall or cover for holding items such as scissors and, of most importance, for holding coupons that have been selected from those stored in the main compartments which are to be used immediately. However, such a pocket could be placed at any convenient location. The separate front wall which can fold forwardly away from the fixed front wall preferably supports a memo pad so that a shopping list or notes can be kept or prepared and carried to the store together with the coupons. The exterior surface of the fixed front wall can include separate holders for other items such as paperclips, writing instruments, stamps that would be convenient to carry or have available while at a store or necessary in work with coupons or labels.

Three relatively larger pockets are attached to the exterior of the case specifically to the two side walls and the rear wall. No top or closure is provided for the rear pocket so that it can receive larger items that are relatively taller than those which could easily fit within the main case. It could hold, for example, envelopes, additional memo pads, bulky items or a checkbook. The two side pockets each have closure flaps and can be used for box tops, special coupons which should be separated from those generally available, proof of purchase seals, entry forms for various types of contests or other unique premium coupons that should be kept separately.

The present invention keeps these various types of coupons in an organized but readily available fashion. Likewise, all the materials or implements needed to cut out labels or to send them back to manufacturers as well as other items that would be helpful to have when shopping are all kept together in one convenient location. Such a device makes shopping more organized and helps assure that coupons will be available for use and used prior to their expiration date thereby maximizing their desired effect.

BRIEF DESCRIPTION OF THE DRAWINGS

These together with other objects and advantages will become more apparent in the following detailed description of the construction and use of the preferred exemplary embodiment of the present invention taken in conjunction with the drawings, which form a part hereof, wherein like numerals refer to like parts throughout, and in which.

DETAILED DESCRIPTION OF THE PREFERRED EXEMPLARY EMBODIMENT OF THE PRESENT INVENTION

Figure 3:
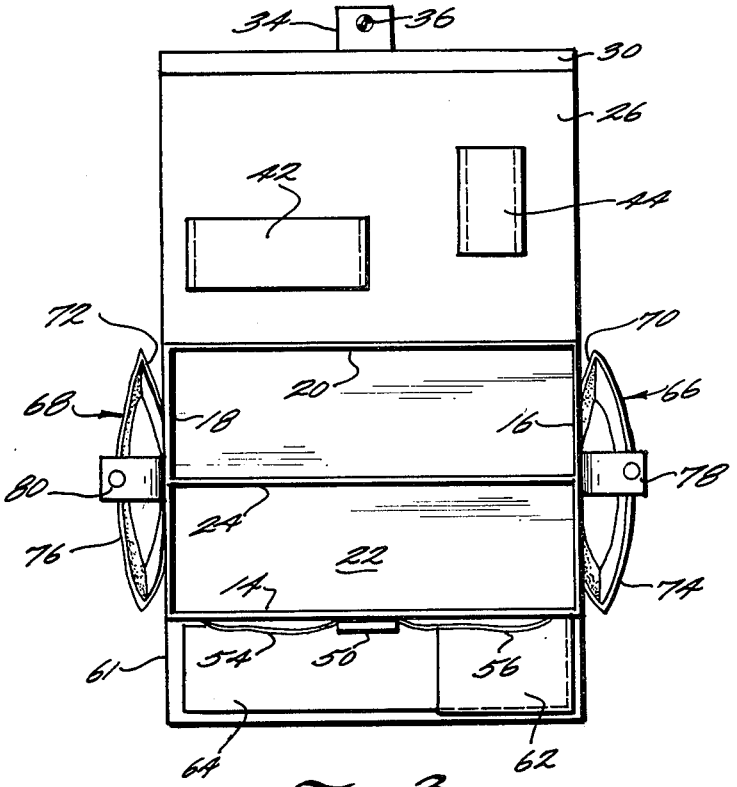
FIG. 3 is a top plan view of the present invention showing an alternative structure for the separate front flap.

Turning now to the figures, the coupon case or secretary, is generally indicated by numeral 10 and is comprised of a box-like structure, generally indicated at 12, comprised of a front wall 14, side walls 16 and 18, rear wall 20, bottom wall 22, as shown in FIG. 3, and an interior divider wall 24.

A movable top 26 is connected to rear wall 20 by any convenient means thereby defining fold line 28 so that top 26 can open and close over the box structure 12. Top 26 is also provided with a separate front flap 30 which again is connected by any convenient means to top 26 thereby defining fold line 32. A closure flap 34 is connected by stitching adhesive rivets, or in any other manner and, in fact, closure flap 34 could be an integral portion of front flap 30. Closure flap 34 is provided with one half of a closure snap 36, the mating portion of which is provided on a separate front flap 38 connected to front wall 14 at the bottom thereof by any convenient means so as to define fold line 40.

Figure 1:
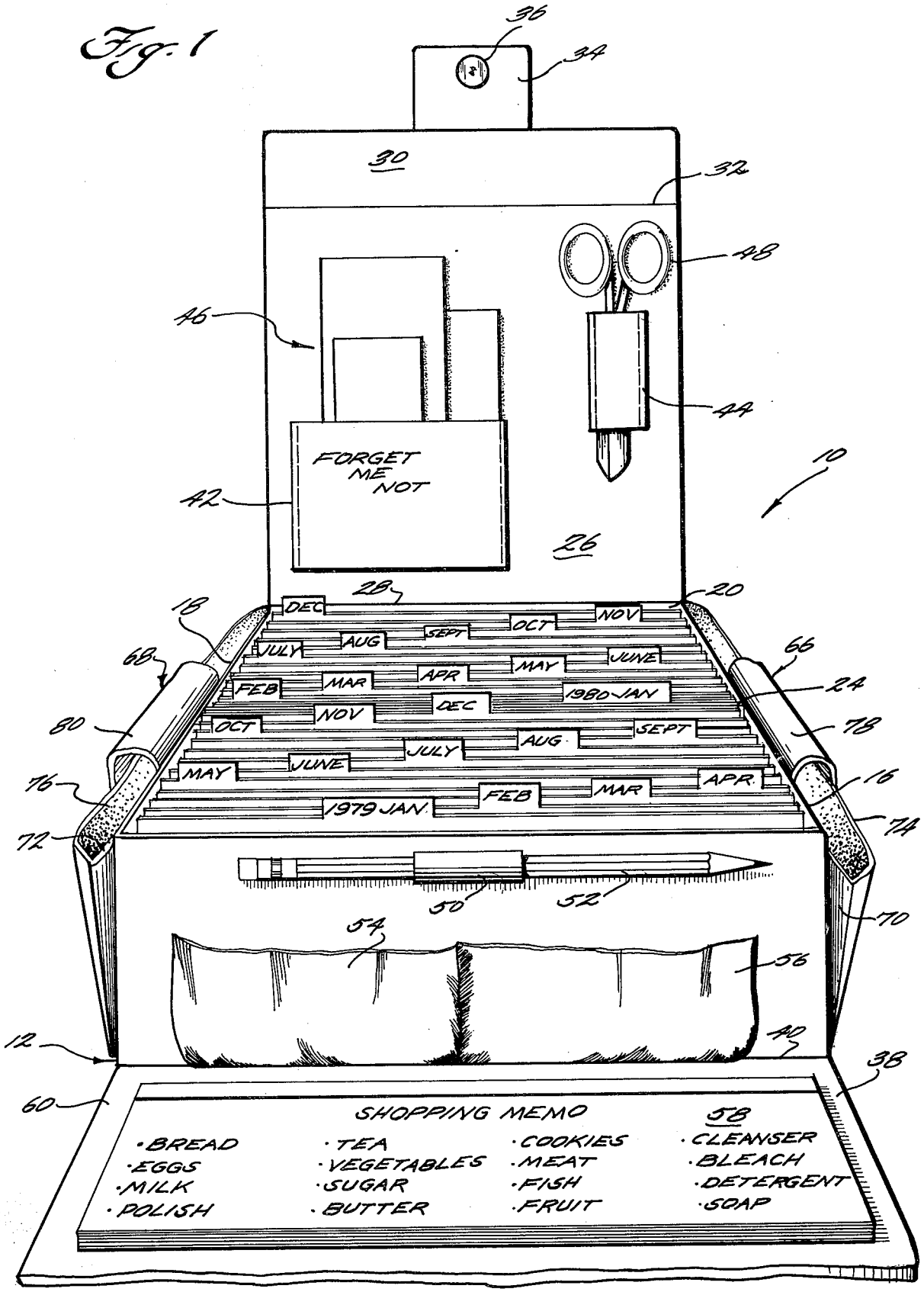
FIG. 1 is a prespective view of the present invention in its open condition.

Turning to FIG. 1, top 26 includes two holders, 42 and 44. Holder 42 is in the form of a pocket and can hold coupons, generally indicated at 46, that have been selected for immediate use during the current shopping trip. Thus, coupons selected from those stored and organized within the device 10 that ought to be used will be immediately and quickly available to the shopper and will not be forgotten. Divider 24 serves together with walls 14–20 to define front and rear sections within the box-like structure 12. As shown in FIG. 1, the area between divider wall 24 and front wall 14 holds a plurality of dividers such as file cards used for separating the one year into its various months from January to December. The rear compartment, defined between divider wall 24 and rear wall 20, holds an additional set of dividers for the following year and again are to divide that year into monthly periods.

Holder 44 serves to retain a pair of scissors 48 which are very often essential in collecting and separating individual coupons. Further, 48 can be used to cut coupons, box ends, etc. to an appropriate size. Coupons can be selected for individual shopping trips from within these two sections and as months pass by, unused coupons that have expired can be thrown out. Selected coupons can be inserted into pocket 42 for immediate use.

Front wall 14 includes a holder 50 for at least one pen or pencil, indicated at 52, although more than one such holder could be used. Pockets 54 and 56 are attached to front wall 14, as by stitching or welding, and can either be provided with elastic tops or can be mounted so as to lie directly adjacent to wall 14. Pockets 54 and 56 can be used to store items such as paperclips or postage stamps or other small items which it might be convenient to have at hand to allow postcards or envelopes to be mailed or coupons or other items to be clipped together.

A shopping pad 58 is removably secured to the inside of the separate front flap 38 such as by having the rear of the memo pad slip within a slot 60 provided within the material forming the exterior of flap 38. It should be understood that flap 38 can be constructed of the same material as the remainder of the device 10. For example, case 10 can be constructed from a cardboard or plastic material which has been covered by a vinyl or fabric material with the covering serving to connect front face 38 and top 26 to the boxlike structure 12. However, the device could also be constructed from metal, wood, plastic or plastic laminated materials with top 26 and front flap 38 being connected by hinges or by any other convenient means. In addition, the device could be made from leather or vinyl materials. Thus, if it was not possible to provide a slit within any fabric covering on the inside of front flap 38 a strap, snaps or other convenient holding method could be used instead of slit 60. For example, an alternative arrangement for the inside face of the separate front flap is shown in FIG. 3 where a separate pocket 62 is stitched or otherwise secured to the inside of flap 61 into which a memo pad 64 can be slid and retained.

Figure 2:
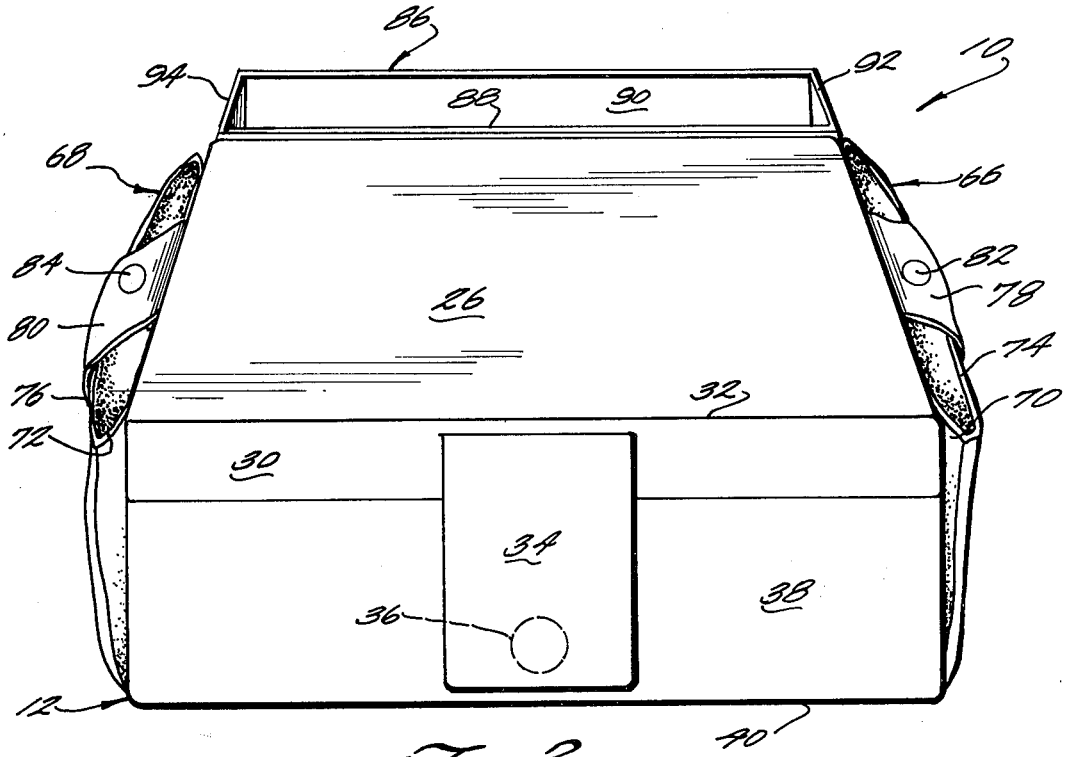
FIG. 2 is a prespective view of the present invention in its closed condition.

Turning our attention back to FIGS. 1 and 2, two pockets, generally indicated at 66 and 68 are connected to the exterior of side walls 16 and 18. As shown, pockets 66 and 68 are preferably made from relatively soft material and include separate rear walls, 70 and 72, stitched or otherwise connected to side walls 16 and 18 respectively. Each pocket also includes separate front walls, 74 and 76, stitched or otherwise connected to the side and bottom periphery of rear walls 70 and 72. Since the material from which pockets 66 and 68 are constructed is relatively soft material, closure flaps 78 and 80 are provided as part of rear walls 70 and 72 and each includes part of a closure snap device 82 and 84 the mating portion being attached to front walls 74 and 76 in order to keep the pockets closed. It should be understood that other closure approaches could be used.

Pockets 66 and 68 could also be constructed from relatively stiff material and in that instance closure flaps 78 and 80 may not be necessary. Likewise, pockets 66 and 68 could be constructed so as to have accordion sides rather than the construction shown in FIG. 2.

Pockets 66 and 68 are used to store separate or special types of coupons, such as premium coupons or mailing coupons, entry forms for various contests conducted by companies, proof of purchase seals, box tops or U.P.C. labels.

A third pocket shown in FIGS. 1 and 3 and generally indicated at 86, is attached to rear wall 20. Pocket 86 is constructed from a rear wall 88, front wall 90, side walls 92 and 94, and a bottom wall (not shown). Pocket 86 is preferably an open pocket, that is, it has no top or closure flap, and is secured to wall 20 by any convenient means such as by stitching or glue. However, it should be understood that pockets 66, 68 and 86 could be molded as integral components of case 10 if it were made from a moldable material.

Pocket 86 is provided for the purpose of storing larger and bulkier items including envelopes, relatively larger or taller coupons or cards, additional pads or other items that either are not as conveniently retained within pockets 66 and 68 or too large or bulky to fit within the two interior compartments described before.

For example, a case according to the present invention could be constructed from separate, pre-cut wall members which have been covered with a fabric material and sewn together in the form shown. The main case could be sized so as to be about 8¼ inches wide, 4 inches high, and 7½ inches deep. The open rear pocket 86 could be an equal depth and length and could extend rearwardly about 2½ inches. By being dimensioned in this matter, the case can easily fit within the fold out infant seat provided on most grocery carts and, accordingly, make the coupons, shopping list, and other items very accessible to the shopper.

While the invention has been described in connection with what is presently concerned to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation of such claims so as to encompass all such equivalent structures.

What I claim is:

1. A portable coupon case for storing and organizing discount coupons and other shopping supplies and for use with shopping carts to allow the case to be taken to the store comprising first case means defined by top, bottom, front, back and opposing side walls for holding and arranging coupons, said top being hingedly secured to said first case means so as to be movable between open and closed positions, said first case means being divided into at least two inner compartments for separating current year and following year coupons, divider means for separately defining month by month sections within each of said at least two inner compartments so that coupons can be arranged according to their expiration dates, first pocket means secured to the exterior of said back wall for holding items relatively larger than coupons, second and third pocket means, respectively attached to said opposing side walls for holding and separating specialty coupons, said second and third pocket means including closure flaps for closing said pocket means, said first case means further including first holder means for holding coupons to be used immediately, second holder means for holding scissors, third holder means for holding a writing instrument, fourth holder means for holding a memo pad, and closure means for securely holding top in a closed position, said first case means further including a separate front panel hingedly attached thereto along the bottom edge of said front wall, said panel having an inside wall portion that fits adjacent the exterior of said front wall for supporting said fourth holder means and an exterior surface forming the exterior of said first case means, said fourth holder means removably securing a memo pad onto the inside wall of said panel, and wherein said first pocket means includes at least side and bottom wall members.

2. A coupon case as in claim 1 wherein said case is comprised of an integral one piece structure molded from a moldable material.

3. A coupon case as in claim 1 wherein said case is constructed from separate, fabric covered wall members which have been stitched together.

4. A coupon case as in claim 1 wherein said case is constructed from a plastic material.

5. A coupon case as in claim 1 wherein said top wall further includes a front flap hingedly connected to the leading edge thereof for closing over the front wall.

6. A case as in claim 5 further including fourth pocket means secured to said front wall so as to be positioned between said front wall and said separate front panel for storing miscellaneous items useful in redeeming coupons.

* * * * *